US011574566B2

(12) United States Patent
Lee

(10) Patent No.: US 11,574,566 B2
(45) Date of Patent: Feb. 7, 2023

(54) POWER VOLTAGE GENERATOR, METHOD OF CONTROLLING THE SAME AND DISPLAY APPARATUS HAVING THE SAME

(71) Applicant: SAMSUNG DISPLAY CO., LTD., Yongin-si (KR)

(72) Inventor: Yoon Young Lee, Asan-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/147,987

(22) Filed: Jan. 13, 2021

(65) Prior Publication Data

US 2021/0248940 A1 Aug. 12, 2021

(30) Foreign Application Priority Data

Feb. 12, 2020 (KR) ..... 10-2020-0017199

(51) Int. Cl.
*G09G 3/00* (2006.01)

(52) U.S. Cl.
CPC ..... *G09G 3/006* (2013.01); *G09G 2330/021* (2013.01); *G09G 2330/028* (2013.01); *G09G 2330/12* (2013.01)

(58) Field of Classification Search
CPC ..... G09G 3/006; G09G 2330/021; G09G 2330/028; G09G 2330/12; G09G 2330/027; G09G 2330/04; G09G 3/3233; G09G 2320/029; G09G 2330/045; G09G 3/3225; G09G 3/3648; G09G 3/3696; G09G 2310/0243
See application file for complete search history.

(56) References Cited

U.S. PATENT DOCUMENTS

| | | | | |
|---|---|---|---|---|
| 5,973,819 | A * | 10/1999 | Pletcher | G02F 1/163 351/44 |
| 9,058,773 | B2 | 6/2015 | Park | |
| 9,251,759 | B2 * | 2/2016 | Said | G09G 5/00 |
| 9,558,692 | B2 * | 1/2017 | Kim | G09G 3/3225 |
| 10,085,333 | B1 * | 9/2018 | Huang | H05B 45/54 |
| 10,720,119 | B2 * | 7/2020 | Tashiro | G09G 3/3611 |
| 11,081,036 | B1 * | 8/2021 | Wang | H03F 3/3022 |
| 2002/0175662 | A1 * | 11/2002 | Sakurai | G09G 3/3696 323/312 |
| 2003/0001808 | A1 * | 1/2003 | Sakuma | G09G 3/3688 345/87 |
| 2004/0196049 | A1 * | 10/2004 | Yano | G09G 3/2085 324/523 |
| 2005/0062685 | A1 * | 3/2005 | Nogawa | G09G 3/32 345/547 |

(Continued)

*Primary Examiner* — Jose R Soto Lopez
(74) *Attorney, Agent, or Firm* — F. Chau & Associates, LLC

(57) ABSTRACT

A power voltage generator includes a first sensor, a second sensor, a comparator and a shutdown controller. The first sensor is configured to sense a first power voltage output node that outputs a first power voltage. The second sensor is configured to sense a second power voltage output node that outputs a second power voltage. The comparator is configured to compare a first sensing signal of the first sensor with a second sensing signal of the second sensor. The shutdown controller is configured to shut down the power voltage generator based on a comparison signal from the comparator.

20 Claims, 8 Drawing Sheets

(56) References Cited

U.S. PATENT DOCUMENTS

2006/0125452 A1* 6/2006 Hsieh ..... G05F 1/46 323/234
2006/0164374 A1* 7/2006 Chang ..... G09G 3/3688 345/100
2007/0063948 A1* 3/2007 Nishimura ..... G09G 3/3688 345/89
2008/0111800 A1* 5/2008 Wang ..... G09G 3/3406 345/204
2008/0258635 A1* 10/2008 Jin ..... G09G 3/296 315/169.4
2009/0153065 A1* 6/2009 Fukuda ..... G09G 3/296 315/169.4
2009/0295776 A1* 12/2009 Yu ..... H05B 45/46 345/212
2010/0013867 A1* 1/2010 Kim ..... G09G 3/3233 313/504
2010/0091220 A1* 4/2010 Lee ..... H05B 41/2855 315/246
2010/0215130 A1* 8/2010 Hsiao ..... G09G 5/006 375/340
2011/0032236 A1* 2/2011 Suzuki ..... G09G 3/006 345/211
2011/0115770 A1* 5/2011 Seo ..... H05B 45/3725 323/283
2011/0128303 A1* 6/2011 Yonemaru ..... H05B 45/385 315/291
2011/0141097 A1* 6/2011 Lee ..... G09G 3/3208 345/212
2011/0273422 A1* 11/2011 Park ..... G09G 3/3233 345/76
2011/0316893 A1* 12/2011 Lee ..... G09G 3/3208 345/77
2012/0044231 A1* 2/2012 Park ..... G06F 1/263 345/211
2012/0050249 A1* 3/2012 Jin ..... G09G 3/20 345/212
2012/0127213 A1* 5/2012 Park ..... G09G 3/32 345/212
2012/0175961 A1* 7/2012 Har-Shai ..... H01L 31/02021 307/80
2012/0280961 A1* 11/2012 Son ..... G09G 3/3685 345/87
2013/0015781 A1* 1/2013 Kanemitsu ..... G09G 3/3406 315/291
2013/0016310 A1* 1/2013 Kanemitsu ..... G08B 5/36 349/69
2013/0038805 A1* 2/2013 Katagiri ..... G09G 3/3696 349/41
2013/0050288 A1* 2/2013 Kang ..... H05B 45/50 315/307
2013/0113844 A1* 5/2013 Kim ..... H05B 45/38 345/82
2013/0235016 A1* 9/2013 Seo ..... G09G 3/3208 345/212
2013/0235017 A1* 9/2013 Park ..... G09G 3/3208 345/82
2013/0241808 A1* 9/2013 Kwon ..... G05F 1/24 323/284
2013/0328854 A1* 12/2013 Ruan ..... G09G 3/3696 345/212
2014/0043314 A1* 2/2014 Park ..... G09G 3/20 345/212
2014/0084792 A1* 3/2014 Oh ..... H05B 47/10 315/120
2014/0354618 A1* 12/2014 Shin ..... G09G 3/3225 345/212
2015/0001504 A1* 1/2015 Kim ..... G09G 3/3233 257/40
2015/0188431 A1* 7/2015 Cho ..... G09G 3/3225 345/212
2015/0309550 A1* 10/2015 Shirakami ..... G09G 3/3696 713/300
2015/0371601 A1* 12/2015 Kim ..... G09G 3/20 345/212
2016/0025791 A1* 1/2016 Bae ..... H02H 3/32 324/140 R
2016/0179179 A1* 6/2016 An ..... G06F 1/263 345/212
2016/0253966 A1* 9/2016 Xie ..... G09G 3/3225 345/213
2016/0255318 A1* 9/2016 Chevallaz ..... G02B 26/0833 348/205
2016/0266590 A1* 9/2016 Ura ..... G05F 1/10
2017/0004773 A1* 1/2017 Kim ..... G09G 3/325
2017/0213490 A1* 7/2017 Jeong ..... G09G 3/20
2017/0243540 A1* 8/2017 Liu ..... G09G 3/3258
2018/0026440 A1* 1/2018 Zhao ..... H01L 27/0285 361/56
2018/0035512 A1* 2/2018 Nagao ..... H05B 45/10
2018/0061342 A1* 3/2018 Abe ..... G09G 3/3648
2018/0076801 A1* 3/2018 Okada ..... H03K 5/003
2018/0109178 A1* 4/2018 Cao ..... H02M 1/08
2018/0166027 A1* 6/2018 Cao ..... H02H 9/005
2018/0212513 A1* 7/2018 Park ..... H02M 3/10
2018/0239379 A1* 8/2018 Zhang ..... G09G 3/3208
2018/0308448 A1* 10/2018 Lee ..... H03K 5/24
2019/0059145 A1* 2/2019 Miyoshi ..... G09G 3/3406
2019/0287447 A1* 9/2019 Zheng ..... G11C 19/28
2019/0386650 A1* 12/2019 Sakaguchi ..... H03K 3/012
2020/0005695 A1* 1/2020 Wang ..... G09G 3/20
2020/0076182 A1* 3/2020 Huang ..... G09G 3/36
2020/0090572 A1* 3/2020 Wu ..... G09G 3/3233
2020/0160766 A1* 5/2020 Ito ..... H01L 24/13
2020/0175906 A1* 6/2020 Lee ..... G09G 3/20
2020/0184890 A1* 6/2020 Kim ..... G09G 3/3233
2020/0251045 A1* 8/2020 An ..... H02H 1/0007
2020/0402455 A1* 12/2020 Kim ..... G09G 3/3225
2021/0003887 A1* 1/2021 Liu ..... G09G 3/3406
2021/0027690 A1* 1/2021 Ji ..... G09G 3/20
2021/0287617 A1* 9/2021 Hu ..... G09G 3/3406

* cited by examiner

FIG. 8

| CODE | DESCRIPTION | CODE | DESCRIPTION | CODE | DESCRIPTION |
|---|---|---|---|---|---|
| 00000 | 20mA | 00110 | 200mA | 01100 | 550mA |
| 00001 | 40mA | 00111 | 250mA | 01110 | 600mA |
| 00010 | 60mA | 01000 | 300mA | 01110 | 650mA |
| 00011 | 80mA | 01001 | 350mA | 01111 | 700mA |
| 00100 | 100mA | 01010 | 450mA | | |
| 00101 | 150mA | 01011 | 500mA | | |

POWER VOLTAGE GENERATOR, METHOD OF CONTROLLING THE SAME AND DISPLAY APPARATUS HAVING THE SAME

CROSS-REFERENCE

This application claims priority under 35 U.S.C. § 119 to Korean Patent Application No. 10-2020-0017199, filed on Feb. 12, 2020 in the Korean Intellectual Property Office KIPO, the contents of which are herein incorporated by reference in their entireties.

TECHNICAL FIELD

Exemplary embodiments of the present inventive concept relate to a power voltage generator, a method of controlling the power voltage generator and a display apparatus including the power voltage generator. More particularly, exemplary embodiments of the present inventive concept relate to a power voltage generator of high safety and reliability, a method of controlling the power voltage generator, and a display apparatus including the power voltage generator.

DISCUSSION OF RELATED ART

Generally, a display apparatus includes a display panel and a display panel driver. The display panel includes a plurality of gate lines, a plurality of data lines, a plurality of emission lines, and a plurality of pixels. The display panel driver includes a gate driver, a data driver, a driving controller and a power voltage generator. The gate driver outputs gate signals to the gate lines. The data driver outputs data voltages to the data lines. The driving controller controls the gate driver and the data driver. The power voltage generator provides a power voltage to the display panel.

The power voltage generator may include a protection circuit to shut down the power voltage generator when a load is suddenly increased due to a short circuit condition at an output terminal due to damage, debris, or the like.

A protection circuit might not sense an open circuit condition at the output terminal. Thus, when an open circuit condition occurs at a pin connecting the display panel and the power voltage generator, the display panel and the data driver might not operate normally, and an overcurrent, overheating and/or fire might occur.

SUMMARY

Exemplary embodiments of the present inventive concept provide a power voltage generator sensing an open circuit condition, hereinafter an "open", of an output part of the power voltage generator, and shutting down the power voltage generator to enhance safety and/or reliability.

Exemplary embodiments of the present inventive concept also provide a method of controlling the power voltage generator.

Exemplary embodiments of the present inventive concept also provide a display apparatus including the power voltage generator.

An exemplary embodiment power voltage generator includes: a first sensor connected to a first power voltage output node; a second sensor connected to a second power voltage output node; a comparator having a non-inverting input connected to the first sensor and an inverting input connected to the second sensor; and a shutdown controller connected to an output of the comparator.

In an exemplary embodiment of a power voltage generator according to the present inventive concept, the power voltage generator includes a first sensor, a second sensor, a comparator, and a shutdown controller. The first sensor is configured to sense a first power voltage output node configured to output a first power voltage. The second sensor is configured to sense a second power voltage output node configured to output a second power voltage. The comparator is configured to compare a first sensing signal of the first sensor and a second sensing signal of the second sensor. The shutdown controller is configured to shut down the power voltage generator based on a comparison signal from the comparator.

In an exemplary embodiment, the first sensor may include a first sensing resistor. A current flowing through the first power voltage output node may be converted into a first sensing voltage by the first sensing resistor.

In an exemplary embodiment, the second sensor may include a second sensing resistor. A current flowing through the second power voltage output node may be converted into a second sensing voltage by the second sensing resistor.

In an exemplary embodiment, the comparator may be configured to receive the first sensing voltage, the second sensing voltage and a reference voltage, and configured to output the comparison signal.

In an exemplary embodiment, the comparator may be configured to compare an absolute value of a difference between the first sensing voltage and the second sensing voltage to the reference voltage.

In an exemplary embodiment, the power voltage generator may further include a counter configured to count a time period during which the absolute value of the difference between the first sensing voltage and the second sensing voltage is greater than the reference voltage.

In an exemplary embodiment, when the time period during which the absolute value of the difference between the first sensing voltage and the second sensing voltage is greater than the reference voltage is greater than a reference time period, the shutdown controller may be configured to shut down the power voltage generator.

In an exemplary embodiment, the power voltage generator may further include an output open detection enable determiner configured to set an activation of a power shutdown function. When the time period during which the absolute value of the difference between the first sensing voltage and the second sensing voltage is greater than the reference voltage is greater than the reference time period and the power shutdown function is activated, the shutdown controller may be configured to shut down the power voltage generator.

In an exemplary embodiment, a plurality of reference voltages including the reference voltage is stored in a register.

In an exemplary embodiment, the power voltage generator may further include a boost converter configured to generate the first power voltage based on an input voltage and an inverting buck-boost converter configured to generate the second power voltage based on the input voltage.

In an exemplary embodiment of a method of controlling a power voltage generator according to the present inventive concept, the method includes sensing a first power voltage output node configured to output a first power voltage, sensing a second power voltage output node configured to output a second power voltage, comparing a first sensing signal sensed at the first power voltage output node and a second sensing signal sensed at the second power voltage output node and shutting down the power voltage generator based on a comparison signal generated by comparing the first sensing signal and the second sensing signal.

In an exemplary embodiment, the sensing the first power voltage output node may include converting a current flowing through the first power voltage output node into a first sensing voltage by a first sensing resistor.

In an exemplary embodiment, the sensing the second power voltage output node may include converting a current flowing through the second power voltage output node into a second sensing voltage by a second sensing resistor.

In an exemplary embodiment, the comparing the first sensing signal and the second sensing signal may include receiving the first sensing voltage, the second sensing voltage and a reference voltage and outputting the comparison signal.

In an exemplary embodiment, an absolute value of a difference between the first sensing voltage and the second sensing voltage may be compared to the reference voltage.

In an exemplary embodiment, the method of controlling a power voltage generator may further include counting a time period during which the absolute value of the difference between the first sensing voltage and the second sensing voltage is greater than the reference voltage.

In an exemplary embodiment, when the time period during which the absolute value of the difference between the first sensing voltage and the second sensing voltage is greater than the reference voltage is greater than a reference time period, the power voltage generator may be shut down.

In an exemplary embodiment, the method of controlling a power voltage generator may further include setting an activation of a power shutdown function. When the time period during which the absolute value of the difference between the first sensing voltage and the second sensing voltage is greater than the reference voltage is greater than the reference time period and the power shutdown function is activated, the power voltage generator may be shut down.

An exemplary embodiment display apparatus includes: a display panel comprising a plurality of pixels; and a power voltage generator configured to provide a first power voltage, and a second power voltage less than the first power voltage, to the display panel, wherein the power voltage generator comprises: a first sensor configured to sense a first power voltage output node having the first power voltage; a second sensor configured to sense a second power voltage output node having the second power voltage; a comparator configured to compare a first sensing signal from the first sensor with a second sensing signal from the second sensor; and a shutdown controller configured to shut down the power voltage generator based on a comparison signal from the comparator In an exemplary embodiment of a display apparatus according to the present inventive concept, the display apparatus includes a display panel, a gate driver, a data driver and a power voltage generator. The display panel includes a plurality of gate lines, a plurality of data lines and a plurality of pixels connected to the gate lines and the data lines. The gate driver is configured to output a gate signal to the gate lines. The data driver is configured to output a data voltage to the data lines. The power voltage generator is configured to provide a first power voltage and a second power voltage less than the first power voltage to the display panel. The power voltage generator includes a first sensor configured to sense a first power voltage output node configured to output the first power voltage, a second sensor configured to sense a second power voltage output node configured to output the second power voltage, a comparator configured to compare a first sensing signal of the first sensor and a second sensing signal of the second sensor and a shutdown controller configured to shut down the power voltage generator based on a comparison signal of the comparator.

In an exemplary embodiment, the comparator may be configured to receive the first sensing voltage, the second sensing voltage and a reference voltage, and configured to output the comparison signal. The comparator may be configured to compare an absolute value of a difference between the first sensing signal and the second sensing signal to the reference voltage.

According to the exemplary embodiment power voltage generator, the exemplary embodiment method of controlling the power voltage generator and the exemplary embodiment display apparatus including the power voltage generator, when an open is occurred at the output terminal of the power voltage generator or the pin connecting the display panel and the power voltage generator, the open occurred at the output terminal of the power voltage generator or the pin connecting the display panel and the power voltage generator may be sensed using the difference between the first sensing voltage and the second sensing voltage so that the power voltage generator may be shut down. Thus, safety and the reliability of the power voltage generator and the display apparatus including the power voltage generator may be controlled. In addition, damage to the power voltage generator and the display apparatus may be prevented in the manufacturing step so that the productivity of the power voltage generator and the display apparatus may be controlled.

BRIEF DESCRIPTION OF THE DRAWINGS

The above and other features of the present inventive concept will become more apparent by describing in detail exemplary embodiments thereof with reference to the accompanying drawings, in which:

FIG. 8 is a tabular diagram illustrating a reference voltage applied to a comparator of FIG. 5;

DETAILED DESCRIPTION

Figure 1:
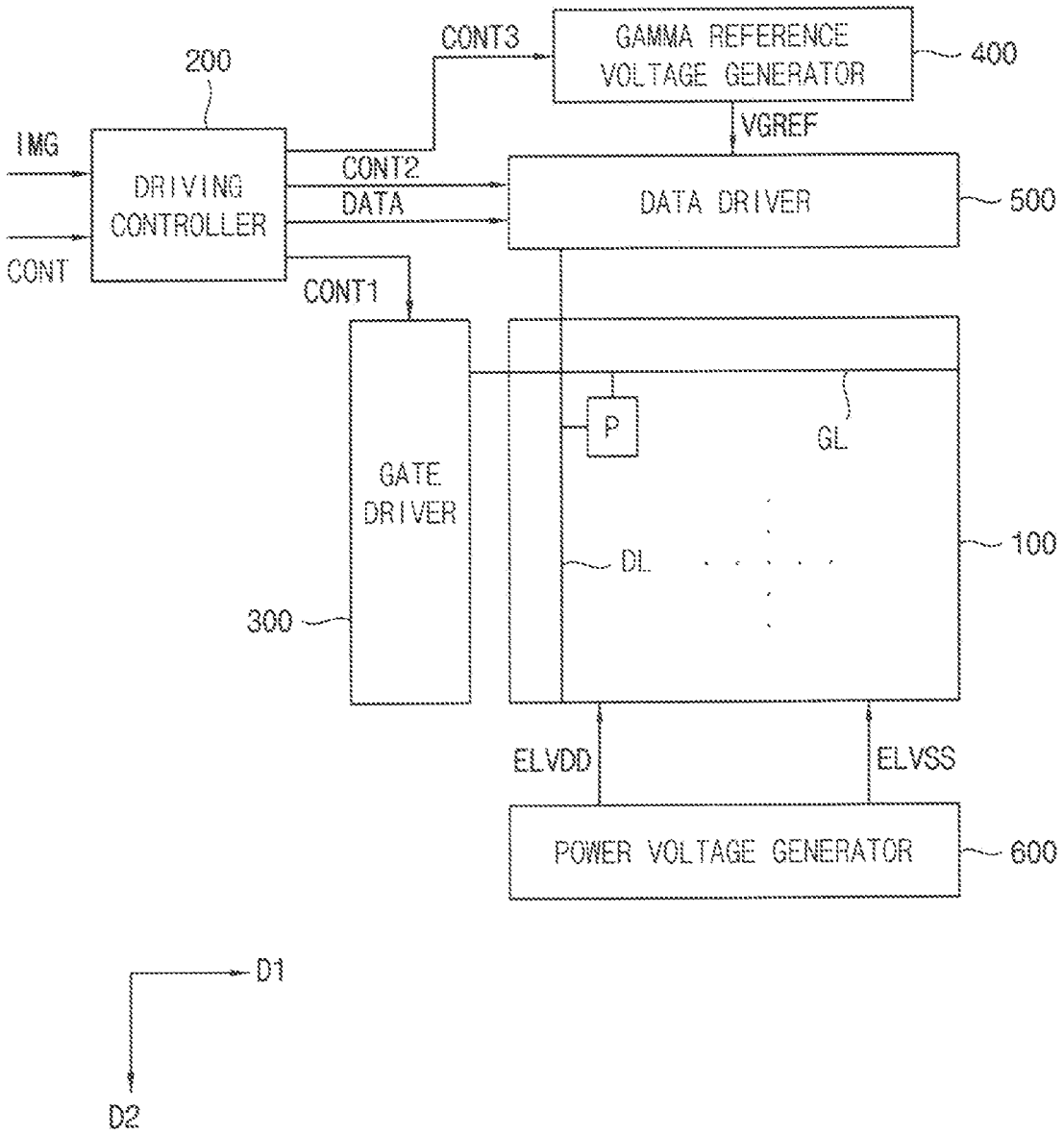
FIG. 1 is a block diagram illustrating a display apparatus according to an exemplary embodiment of the present inventive concept.

Exemplary embodiments of the present inventive concept will be described more fully hereinafter with reference to the accompanying drawings, in which various embodiments are shown. The present inventive concept may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals may refer to like elements throughout.

It will be understood that, although the terms "first," "second," "third" etc. may be used herein to describe various elements, components, regions, layers and/or sections, these elements, components, regions, layers and/or sections should not be limited by these terms. These terms are used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only, and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the disclosure, and will not be interpreted in an idealized or overly formal sense unless expressly so defined herein.

Hereinafter, the present inventive concept will be explained in detail with reference to the accompanying drawings.

FIG. 1 illustrates a display apparatus according to an exemplary embodiment of the present inventive concept.

Referring to FIG. 1, the display apparatus includes a display panel 100 and a display panel driver. The display panel driver includes a driving controller 200, a gate driver 300, a gamma reference voltage generator 400 and a data driver 500. The display panel driver further includes a power voltage generator 600.

For example, the driving controller 200 and the data driver 500 may be integrally formed. For example, the driving controller 200, the gamma reference voltage generator 400 and the data driver 500 may be integrally formed. A driving module including at least the driving controller 200 and the data driver 500 which are integrally formed may be called a timing controller embedded data driver (TED).

The display panel 100 has a display region on which an image is displayed and a peripheral region adjacent to the display region.

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1.

In an exemplary embodiment, the display panel 100 may be an organic light emitting display panel including organic light emitting elements. Alternatively, the display panel 100 may be a liquid crystal display panel including liquid crystal molecules. Alternatively, the display panel 100 may be an inorganic light emitting display panel. Alternatively, the display panel 100 may be a light emitting diode display panel.

The driving controller 200 receives input image data IMG and an input control signal CONT from an external apparatus. The input image data IMG may include red image data, green image data and blue image data. The input image data IMG may include white image data. The input image data IMG may include magenta image data, yellow image data and cyan image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT, and outputs the third control signal CONT3 to the gamma reference voltage generator 400.

The gate driver 300 generates gate signals driving the gate lines GL in response to the first control signal CONT1 received from the driving controller 200. The gate driver 300 outputs the gate signals to the gate lines GL. For example, the gate driver 300 may sequentially output the gate signals to the gate lines GL. For example, the gate driver 300 may be integrated on the peripheral region of the display panel 100. For example, the gate driver 300 may be mounted on the peripheral region of the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The power voltage generator 600 may generate a power voltage for driving at least one of the display panel 100, the driving controller 200, the gate driver 300, the gamma reference voltage generator 400 and the data driver 500.

For example, the power voltage generator 600 may generate a first power voltage ELVDD and a second power voltage ELVSS applied to the pixels P of the display panel 100, and output the first power voltage ELVDD and the second power voltage ELVSS to the display panel 100. The second power voltage ELVSS may be a lower potential than the first power voltage ELVDD.

Figure 2:
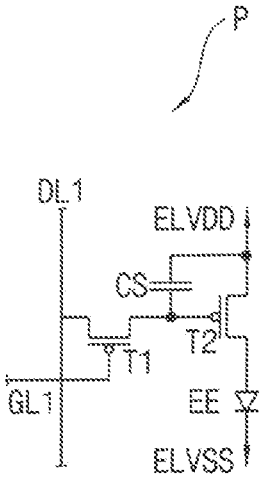
FIG. 2 is a circuit diagram illustrating a pixel structure of a display panel of FIG. 1.

FIG. 2 illustrates a pixel structure of the display panel 100 of FIG. 1.

Referring to FIGS. 1 and 2, the display panel 100 displays an image. The display panel 100 includes the gate lines GL, the data lines DL and the pixels P connected to the gate lines GL and the data lines DL. For example, the pixels P may be disposed with other pixels in a matrix arrangement.

In an exemplary embodiment, the number of the gate lines may be N, the number of the data lines may be M and the number of the pixels P may be N×M. Herein, N and M are natural numbers.

The display panel 100 is connected to the gate driver 300 through the gate lines GL and connected to the data driver 500 through the data lines DL. For example, the pixel P is connected to the gate driver 300 through the gate line GL1 and connected to the data driver 500 through the data line DL1.

The display panel receives the first power voltage ELVDD and the second power voltage ELVSS from the power voltage generator 600. The first power voltage ELVDD may be applied to first electrodes of light emitting elements of the pixels P. The second power voltage ELVSS may be applied to second electrodes of the light emitting elements of the pixels P.

The pixel P includes a first pixel switching element T1, a second pixel switching element T2, a storage capacitor CS and the light emitting element EE.

The first pixel switching element T1 may be a thin film transistor. The first pixel switching element T1 includes a control electrode connected to the gate line GL1, an input electrode connected to the data line DL1 and an output electrode connected to a control electrode of the second pixel switching element T2.

The control electrode of the first pixel switching element T1 may be a gate electrode. The input electrode of the first pixel switching element T1 may be a source electrode. The output electrode of the first pixel switching element T1 may be a drain electrode.

The second pixel switching element T2 includes a control electrode connected to the output electrode of the first pixel switching element T1, an input electrode to which the first power voltage ELVDD is applied and an output electrode connected to a first electrode of the light emitting element EE.

The second pixel switching element T2 may be a thin film transistor. The control electrode of the second pixel switching element T2 may be a gate electrode. The input electrode of the second pixel switching element T2 may be a source electrode. The output electrode of the second pixel switching element T2 may be a drain electrode.

A first end of the storage capacitor CS is connected to the input electrode of the second pixel switching element T2. A second end of the storage capacitor CS is connected to the output electrode of the first pixel switching element T1.

The first electrode of the light emitting element EE is connected to the output electrode of the second pixel switching element T2. The second power voltage ELVSS is applied to the second electrode of the light emitting element EE.

The first electrode of the light emitting element EE may be an anode electrode. The second electrode of the light emitting element EE may be a cathode electrode.

The pixel P receives the gate signal, the data signal, the first power voltage ELVDD and the second power voltage ELVSS and emits the light emitting element EE in a luminance corresponding to the data signal to display an image.

Figure 3:
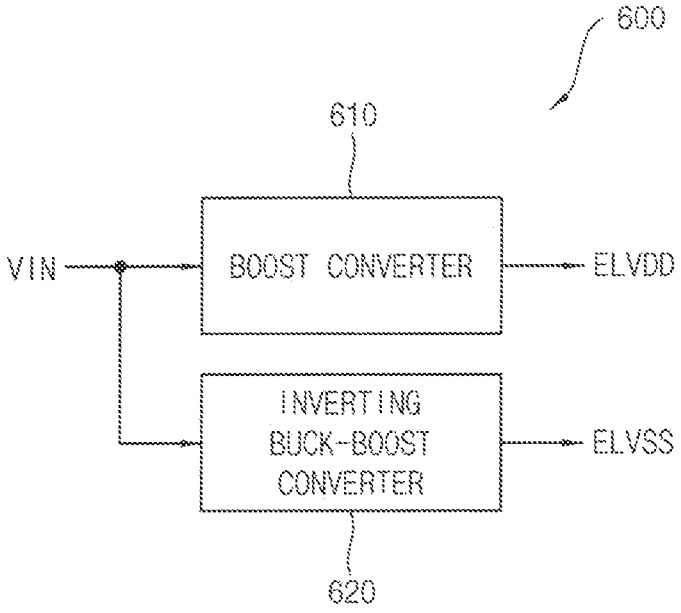
FIG. 3 is a block diagram illustrating a power voltage generator of FIG. 1.

FIG. 3 illustrates the power voltage generator 600 of FIG. 1.

Referring to FIGS. 1 to 3, the power voltage generator 600 may include a first DC-DC converter 610 and a second DC-DC converter 620.

The power voltage generator 600 may include the first DC-DC converter 610 generating the first power voltage ELVDD based on an input voltage VIN and the second DC-DC converter 620 generating the second power voltage ELVSS based on the input voltage VIN.

For example, the first DC-DC converter 610 may be a boost converter. For example, the second DC-DC converter 620 may be an inverting buck-boost converter.

Figure 4:
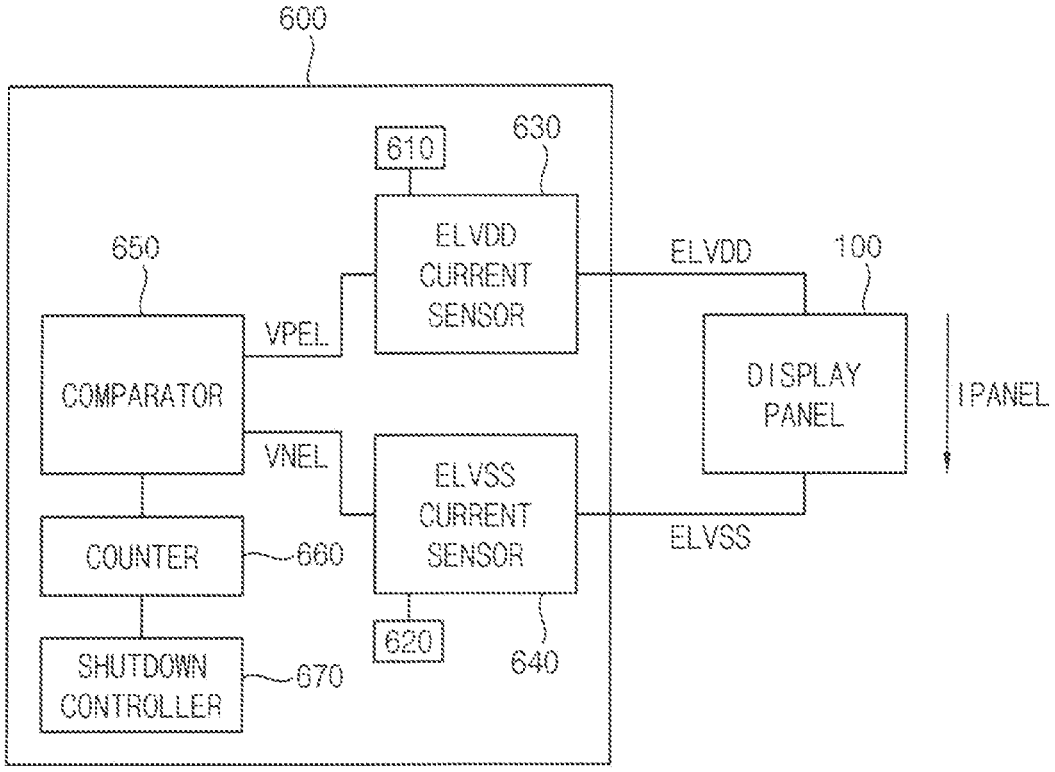
FIG. 4 is a block diagram illustrating a connection between the power voltage generator and the display panel of FIG. 1.
Figure 5:
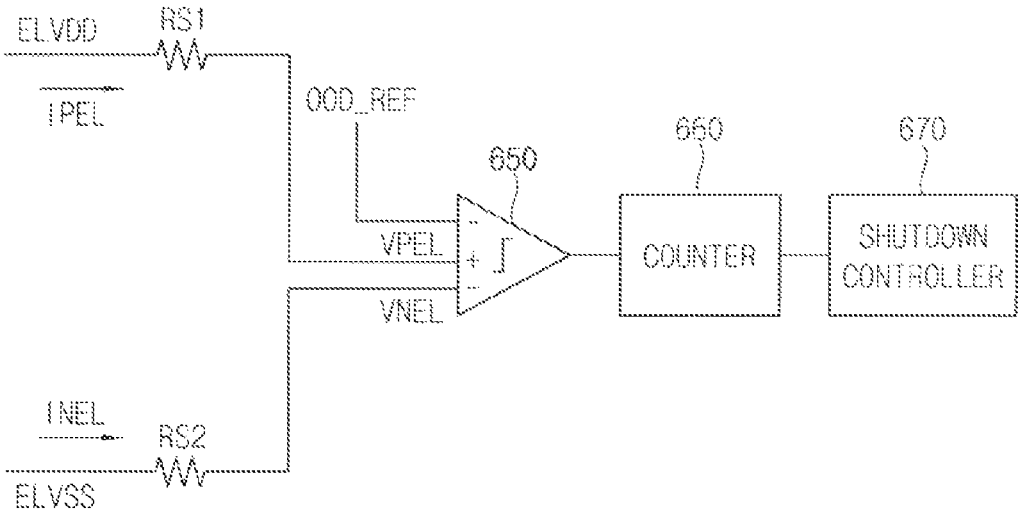
FIG. 5 is a circuit diagram illustrating the power voltage generator of FIG. 1.
Figure 6:
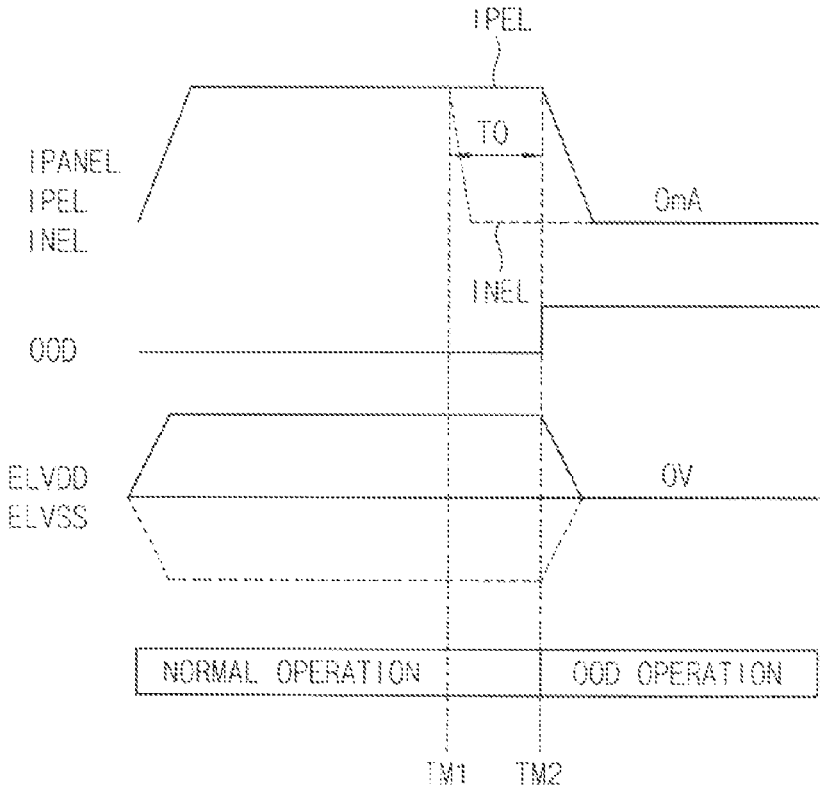
FIG. 6 is a timing diagram illustrating input signals and output signals of the power voltage generator of FIG. 1.

FIG. 4 illustrates a connection between the power voltage generator 600 and the display panel 100 of FIG. 1. FIG. 5 illustrates part of the power voltage generator 600 of FIG. 1. FIG. 6 illustrates input signals and output signals of the power voltage generator 600 of FIG. 1.

Referring to FIGS. 1 to 6, the power voltage generator 600 further includes a first sensor 630 connected to the first DC-DC converter 610, a second sensor 640 connected to the second DC-DC converter 620, a comparator 650 and a shutdown controller 670.

The first sensor 630 senses a first power voltage output node outputting the first power voltage ELVDD. For example, the first sensor 630 may include a first sensing resistor RS1. A current IPEL flowing through the first power voltage output node may be converted into a first sensing voltage VPEL by the first sensing resistor RS1. The first sensor 630 may be referred to an ELVDD current sensor. In an alternate embodiment, the first sensor may be an inductive sensor.

The second sensor 640 senses a second power voltage output node outputting the second power voltage ELVSS. For example, the second sensor 640 may include a second sensing resistor RS2. A current INEL flowing through the second power voltage output node may be converted into a second sensing voltage VNEL by the second sensing resistor RS2. The second sensor 640 may be referred to an ELVSS current sensor. In an alternate embodiment, the second sensor may be an inductive sensor.

The first power voltage ELVDD and the second power voltage ELVSS are applied to the end portions of the light emitting element EE. The light emitting element EE is a diode so that the current IPEL flowing through the first power voltage output node may be substantially the same as the current INEL flowing through the second power voltage output node (IPANEL=IPEL=INEL) when the power voltage generator 600 and the display panel 100 are normally connected to each other during normal operation. The comparator 650 compares a first sensing signal (e.g. VPEL) from the first sensor 630 and a second sensing signal (e.g. VNEL) from the second sensor 640.

The comparator 650 may receive the first sensing voltage VPEL, the second sensing voltage VNEL and an output open detection reference voltage OOD_REF, and may output a comparison signal.

The comparator 650 may compare a difference or an absolute value of a difference between the first sensing voltage VPEL and the second sensing voltage VNEL to the reference voltage OOD_REF. The reference voltage OOD_REF may be a value representing whether the power voltage generator 600 and the display panel 100 are normally connected to each other during normal operation. For example, when the absolute value of the difference between the first sensing voltage VPEL and the second sensing voltage VNEL is greater than the reference voltage OOD_REF, it means that the power voltage generator 600 and the display panel 100 are not normally connected. In contrast, when the absolute value of the difference between the first sensing voltage VPEL and the second sensing voltage VNEL is equal to or less than the reference voltage OOD_REF, it means that the power voltage generator 600 and the display panel 100 are normally connected. For example, when the absolute value of the difference between the first sensing voltage VPEL and the second sensing voltage VNEL is greater than the reference voltage OOD_REF, the comparator 650 may output the comparison signal having an activated level. In contrast, when the absolute value of the difference between the first sensing voltage VPEL and the second sensing voltage VNEL is equal to or less than the reference voltage OOD_REF, the comparator 650 may output the comparison signal having an inactivated level.

The power voltage generator 600 may further include a counter 660 counting a time period during which the absolute value of the difference between the first sensing voltage VPEL and the second sensing voltage VNEL is greater than the reference voltage OOD_REF.

The shutdown controller 670 shuts down the power voltage generator 600 based on the comparison signal of the comparator 650. For example, when the time period, during which the absolute value of the difference between the first sensing voltage VPEL and the second sensing voltage VNEL is greater than the reference voltage OOD_REF or excessive, is greater than a reference time period TO, the shutdown controller 670 may shut down the power voltage generator 600.

When the excessive difference between the first sensing voltage VPEL and the second sensing voltage VNEL is instantly generated or transient for less than the reference time period TO, the shutdown controller 670 need not shut down the power voltage generator 600. When the excessive difference between the first sensing voltage VPEL and the second sensing voltage VNEL is maintained over at least the reference time period TO, the shutdown controller 670 may shut down the power voltage generator 600.

In FIG. 6, when the first power voltage ELVDD and the second power voltage ELVSS have normal levels, the power voltage generator 600 may operate normally.

In a first time point TM1, an open may occur at the second power voltage output node or a connecting portion between the second power voltage output node and the display panel 100. Then the level of the current INEL flowing through the second power voltage output node decreases so that a difference between the current IPEL flowing through the first power voltage output node and the current INEL flowing through the second power voltage output node may be generated. When the difference between the first sensing signal (IPEL, or VPEL corresponding to IPEL) and the second sensing signal (INEL, or VNEL corresponding to INEL) is maintained until a second time point TM2, the difference between the first sensing signal and the second sensing signal may exceed the reference time period TO. When the difference between the first sensing signal and the second sensing signal exceeds the reference time period TO, the shutdown controller 670 may initiate an output open detection (OOD) operation shutting down the power voltage generator 600.

In FIG. 6, an output open detection or OOD signal may be a control signal output from the shutdown controller 670 to shut down the power voltage generator 600. When the OOD signal has a high level, the power voltage generator 600 may be shut down as part of the OOD operation. When the OOD signal has a low level, the power voltage generator 600 need not be shut down as part of the normal operation.

Figure 7:
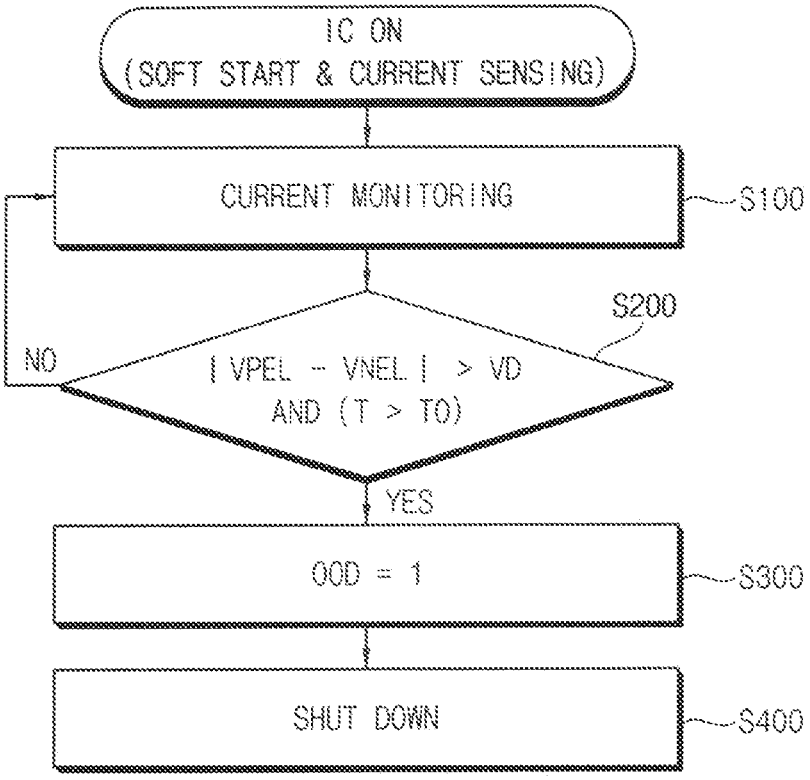
FIG. 7 is a flowchart diagram illustrating a method of controlling the power voltage generator of FIG. 1.

FIG. 7 illustrates a method of controlling the power voltage generator 600 of FIG. 1.

Referring to FIGS. 1 to 7, the power voltage generator 600 may be turned on and the current may be sensed.

The method of controlling the power voltage generator 600 may include a step S100 of sensing the first power voltage output node outputting the first power voltage ELVDD and the second power voltage output node outputting the second power voltage ELVSS.

The first sensing signal VPEL sensed at the first power voltage output node may be compared to the second sensing signal VNEL sensed at the second power voltage output node over a period of time T (step S200).

When the time period T, during which the absolute value of the difference between the first sensing voltage VPEL and the second sensing voltage VNEL is greater than the reference voltage OOD_REF or VD, is greater than the reference time period TO, the shutdown controller 670 may activate the OOD signal (step S300) and may implement the OOD operation shutting down the power voltage generator 600 (step S400).

When the time period during which the absolute value of the difference between the first sensing voltage VPEL and the second sensing voltage VNEL is equal to or less than the reference voltage OOD_REF or VD, the first power voltage output node and the second power voltage output node are monitored (step S100). In addition, when the time period during which the absolute value of the difference between the first sensing voltage VPEL and the second sensing voltage VNEL is greater than the reference voltage OOD_REF or VD is not maintained over the reference time period TO, the first power voltage output node and the second power voltage output node are monitored (step S100).

FIG. 8 illustrates a table of potential output open detection reference voltages OOD_REF corresponding to the indicated current differences applied to the comparator 650 of FIG. 5.

Referring to FIGS. 1 to 8, the reference voltage OOD_REF may represent the difference between the first sensing voltage VPEL and the second sensing voltage VNEL defining an abnormal status. For example, when the reference voltage OOD_REF is a voltage corresponding to a difference in current of 20 mA, the comparator 650 may output the comparison signal having the activated level when the difference between the first sensing voltage VPEL and the second sensing voltage VNEL exceeds the voltage corresponding to a current of 20 mA, which would be indicative of an actual current less than 20 mA.

As shown in FIG. 8, a plurality of the reference voltages OOD_REF may be stored in a register. The register may be included in the power voltage generator 600. Alternatively, the register may be disposed outside of the power voltage generator 600. The register may be included in the driving controller 200.

For example, a first column of the register may include an identification code CODE. A second column of the register may include DESCRIPTION corresponding to the identification code. Herein, the DESCRIPTION may represent the reference voltage OOD_REF. For example, when the identification code (CODE) is "00000," the reference voltage (DESCRIPTION) may be a voltage corresponding to 20 mA. For example, when the identification code (CODE) is "00001," the reference voltage (DESCRIPTION) may be a voltage corresponding to 40 mA. For example, when the identification code (CODE) is "00010," the reference voltage (DESCRIPTION) may be a voltage corresponding to 60 mA. In this way, the register in FIG. 8 may store the voltages corresponding to 20 mA to 700 mA as the reference voltage (DESCRIPTION).

The plurality of the reference voltages (e.g. the voltages corresponding to 20 mA to 700 mA) stored in the register may be determined according to a status (e.g. a size, a pixel structure, a driving method or the like) of the display panel 100 connected to the power voltage generator 600. An appropriate one of the plurality of the reference voltages (e.g. the voltages corresponding to 20 mA to 700 mA) stored in the register may be selected according to the status (e.g. size, pixel structure, driving method or the like) of the display panel 100 connected to the power voltage generator 600.

According to the present exemplary embodiment, when an open occurs at the output terminal of the power voltage generator 600 or at the pin connecting the display panel 100 and the power voltage generator 600, the open that occurred at the output terminal of the power voltage generator 600 or the pin connecting the display panel 100 and the power voltage generator 600 may be sensed using the difference between the first sensing voltage VPEL and the second sensing voltage VNEL so that the power voltage generator 600 may be shut down. Thus, the safety and the reliability of the power voltage generator 600, and the display apparatus including the power voltage generator 600, may be controlled. In addition, damage to the power voltage generator 600 and the display apparatus may be prevented in the manufacturing step, and manufacturing productivity of the power voltage generator 600 and the display apparatus may be controlled.

Figure 9:
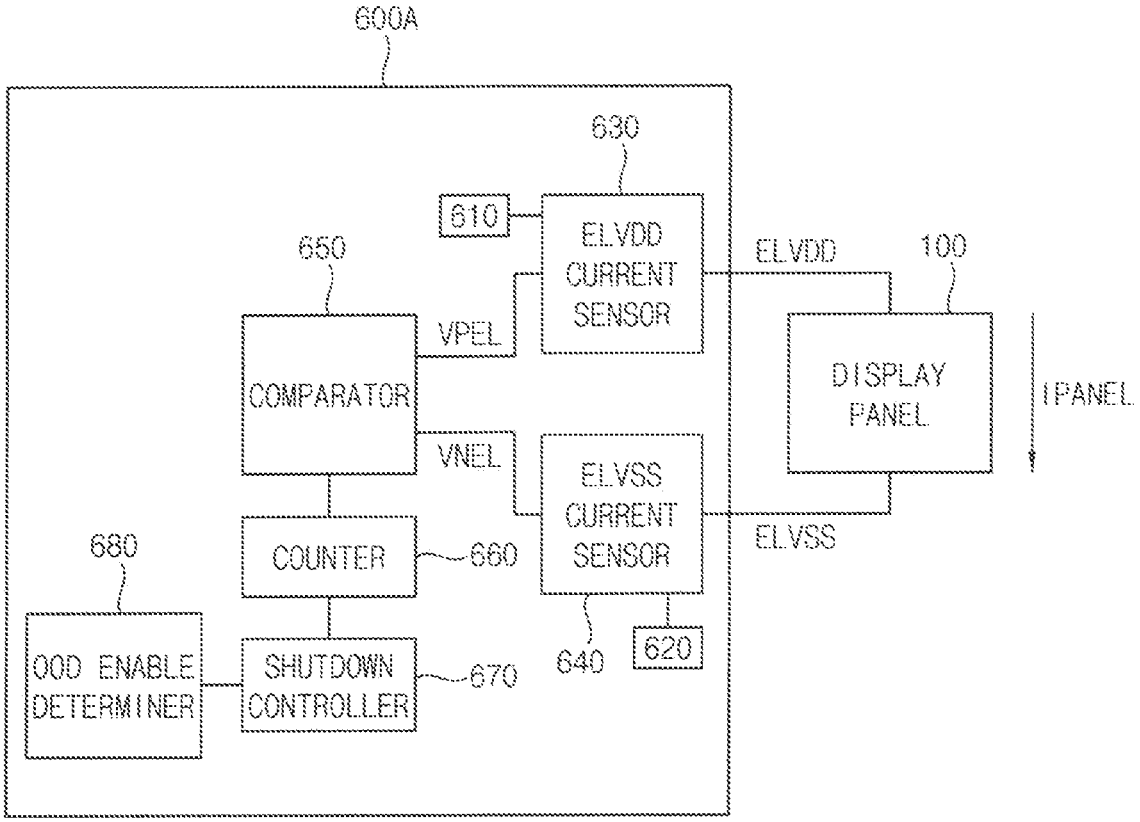
FIG. 9 is a block diagram illustrating a connection between a power voltage generator and a display panel of a display apparatus according to an exemplary embodiment of the present inventive concept.
Figure 10:
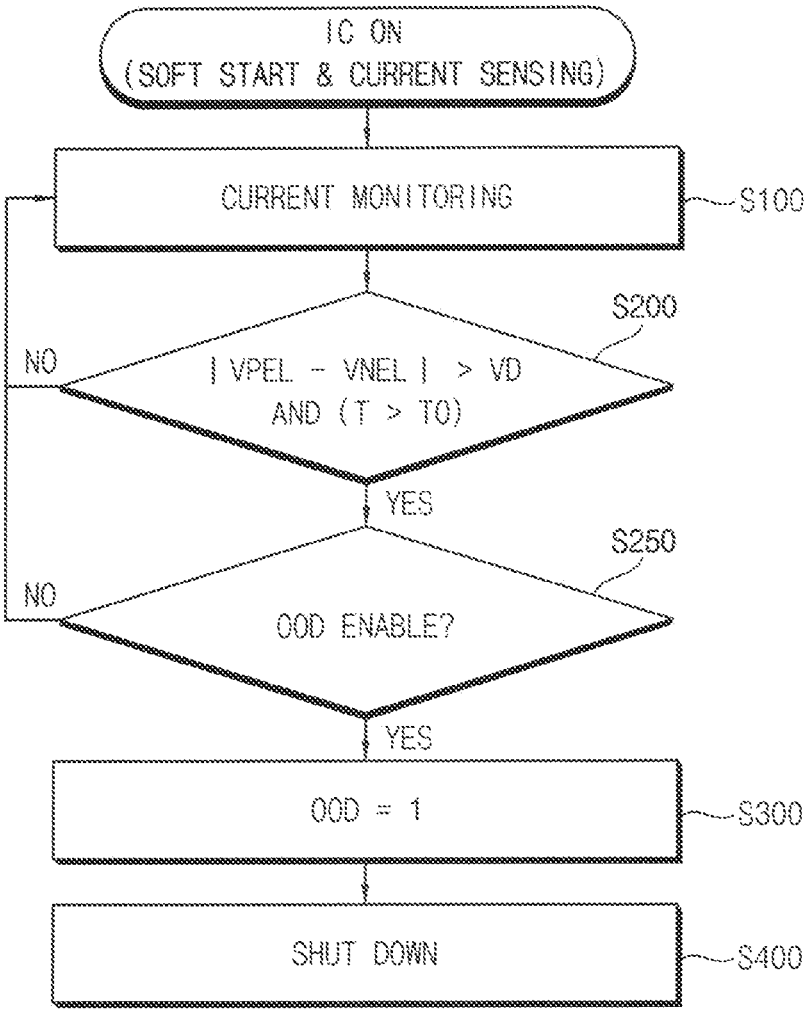
FIG. 10 is a flowchart diagram illustrating a method of controlling the power voltage generator of FIG. 9.

FIG. 9 illustrates a connection between a power voltage generator 600A and a display panel 100 of a display apparatus according to an exemplary embodiment of the present inventive concept. FIG. 10 illustrates a method of controlling the power voltage generator 600A of FIG. 9.

The display apparatus according to the present exemplary embodiment is substantially the same as the display apparatus according to the previous exemplary embodiment explained with reference to FIGS. 1 to 8, except for the structure of the power voltage generator as shown or described in FIGS. 4 and/or 7. Thus, the same reference numerals may be used to refer to the same or like parts as those described in the previous exemplary embodiment of FIGS. 1 to 8, and any repetitive explanation concerning the above elements may be omitted.

Referring to FIGS. 1 to 3, 9 and 10, the display apparatus includes a display panel 100 and a display panel driver. The display panel driver includes a driving controller 200, a gate driver 300, a gamma reference voltage generator 400 and a data driver 500. The display panel driver further includes a power voltage generator 600A.

As shown in FIG. 9, the power voltage generator 600A includes a first DC-DC converter 610, a first sensor 630, a second DC-DC converter 620, a second sensor 640, a comparator 650, a counter 660, a shutdown controller 670, and an output open detection (OOD) enable determiner 680.

The comparator 650 may receive a first sensing voltage VPEL, a second sensing voltage VNEL and a reference voltage OOD_REF and may output a comparison signal.

The counter 660 may count a time period during which the absolute value of the difference between the first sensing voltage VPEL and the second sensing voltage VNEL is greater than the reference voltage OOD_REF.

In addition, the power voltage generator 600A may further include the output open detection (OOD) enable determiner 680 setting activation of a power shutdown function.

In the present exemplary embodiment, when the time period T, during which the absolute value of the difference between the first sensing voltage VPEL and the second sensing voltage VNEL is greater than the reference voltage OOD_REF, is greater than a reference time period TO, and the power shutdown function is activated, the shutdown controller 670 may shut down the power voltage generator 600A.

As shown in FIG. 10, the method of controlling the power voltage generator 600A of FIG. 9 may include a step S100 of sensing the first power voltage output node outputting the first power voltage ELVDD and the second power voltage output node outputting the second power voltage ELVSS.

The first sensing signal VPEL sensed at the first power voltage output node may be compared to the second sensing signal VNEL sensed at the second power voltage output node over a period of time T (step S200).

In addition, the activation of the power shutdown function may be determined (step S250).

When the time period T, during which the absolute value of the difference between the first sensing voltage VPEL and the second sensing voltage VNEL is greater than the reference voltage OOD_REF or VD, is greater than the reference time period TO, and the power shutdown function is activated, the shutdown controller 670 may activate the OOD signal (step S300) and may execute the OOD operation shutting down the power voltage generator 600A (step S400).

When the time period T, during which the absolute value of the difference between the first sensing voltage VPEL and the second sensing voltage VNEL is equal to or less than the reference voltage OOD_REF or VD, the first power voltage output node and the second power voltage output node are monitored (step S100). In addition, when the time period T, during which the absolute value of the difference between the first sensing voltage VPEL and the second sensing voltage VNEL is greater than the reference voltage OOD_REF or VD, is not maintained over the reference time period TO, the first power voltage output node and the second power voltage output node are monitored (step S100). In addition, when the power shutdown function is inactivated, the first power voltage output node and the second power voltage output node may be monitored (step S100).

According to the present exemplary embodiment, when an open occurs at the output terminal of the power voltage generator 600A or at the pin connecting the display panel 100 and the power voltage generator 600A, the open that occurred at the output terminal of the power voltage generator 600A or the pin connecting the display panel 100 and the power voltage generator 600A may be sensed using the difference between the first sensing voltage VPEL and the second sensing voltage VNEL so that the power voltage generator 600A may be shut down. Thus, the safety and the reliability of the power voltage generator 600A and the display apparatus including the power voltage generator 600A may be controlled. In addition, damage to the power voltage generator 600A and/or the display apparatus may be prevented in the manufacturing step so that the manufacturing productivity of the power voltage generator 600A and/or the display apparatus may be controlled.

According to the present inventive concept as explained above, the safety and the reliability of the display apparatus may be controlled and the productivity of the display apparatus may be controlled.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific exemplary embodiments disclosed, and that modifications to the disclosed exemplary embodiments, as well as other exemplary embodiments, are intended to be included within the scope of the appended claims. The present inventive concept is defined by the following claims, with equivalents of the claims to be included therein.

What is claimed is:

1. A power voltage generator comprising:

a first sensor connected to a first power voltage output node;

a second sensor connected to a second power voltage output node;

a comparator having a non-inverting input connected to the first sensor, an inverting input connected to the second sensor, a second inverting input connected to an output detection reference signal, and one output; and a shutdown controller connected to the output of the comparator.

2. The power voltage generator of claim 1, wherein the first sensor comprises a first sensing resistor directly connected to the non-inverting input, and wherein a current flowing through the first power voltage output node is converted into a first sensing voltage by the first sensing resistor.

3. The power voltage generator of claim 2, wherein the second sensor comprises a second sensing resistor directly connected to the inverting input, and wherein a current flowing through the second power voltage output node is converted into a second sensing voltage by the second sensing resistor.

4. The power voltage generator of claim 3, wherein the comparator is configured to receive the first sensing voltage from the first sensor, the second sensing voltage from the first sensor, and the output detection reference signal, and configured to output a comparison signal.

5. The power voltage generator of claim 4, wherein the comparator is configured to compare an absolute value of a difference between the first sensing voltage and the second sensing voltage to the output detection reference signal.

6. The power voltage generator of claim 5, further comprising a counter configured to count a time period during which the absolute value of the difference between the first sensing voltage and the second sensing voltage is greater than the output detection reference signal.

7. The power voltage generator of claim 6, wherein when the time period is greater than a reference time period, the shutdown controller is configured to shut down the power voltage generator.

8. The power voltage generator of claim 7, further comprising an output open detection enable determiner configured to set an activation of a power shutdown function, wherein when the time period is greater than the reference time period and the power shutdown function is activated, the shutdown controller is configured to shut down the power voltage generator.

9. The power voltage generator of claim 4, wherein the output detection reference signal is a selected one of a plurality of reference voltages stored in a register.

10. The power voltage generator of claim 1, further comprising:

a boost converter connected to the first power voltage output node and configured to generate a first power voltage based on an input voltage; and an inverting buck-boost converter connected to the second power voltage output node and configured to generate a second power voltage based on the input voltage.

11. A method of controlling a power voltage generator, the method comprising:

sensing a first power voltage output node configured to output a first power voltage;

sensing a second power voltage output node configured to output a second power voltage;

comparing a first sensing signal sensed at the first power voltage output node with a second sensing signal sensed at the second power voltage output node and an output detection reference signal to generate one comparison signal; and shutting down the power voltage generator based on the comparison signal generated by comparing the first sensing signal with the second sensing signal.

12. The method of claim 11, wherein sensing the first power voltage output node comprises converting a current flowing through the first power voltage output node into a first sensing voltage by a first sensing resistor.

13. The method of claim 12, wherein sensing the second power voltage output node comprises converting a current flowing through the second power voltage output node into a second sensing voltage by a second sensing resistor.

14. The method of claim 13, wherein comparing the first sensing signal and the second sensing signal comprises:

receiving the first sensing voltage, the second sensing voltage, and a output detection reference signal; and outputting the comparison signal.

15. The method of claim 14, wherein an absolute value of a difference between the first sensing voltage and the second sensing voltage is compared to the output detection reference signal.

16. The method of claim 15, further comprising counting a time period during which the absolute value of the difference between the first sensing voltage and the second sensing voltage remains greater than the output detection reference signal.

17. The method of claim 16, wherein when the time period is greater than a reference time period, the power voltage generator is shut down.

18. The method of claim 17, further comprising setting an activation of a power shutdown function, wherein when the time period is greater than the reference time period and the power shutdown function is activated, the power voltage generator is shut down.

19. A display apparatus comprising:

a display panel comprising a plurality of pixels; and a power voltage generator configured to provide a first power voltage, and a second power voltage less than the first power voltage, to the display panel, wherein the power voltage generator comprises:

a first sensor configured to sense a first power voltage output node having the first power voltage;

a second sensor configured to sense a second power voltage output node having the second power voltage;

a comparator configured to compare a first sensing signal from the first sensor with a second sensing signal from the second sensor and an output detection reference signal to generate one comparison signal; and a shutdown controller configured to shut down the power voltage generator based on the comparison signal from the comparator.

20. The display apparatus of claim 19, wherein the comparator is configured to compare an absolute value of a difference, between the first sensing signal and the second sensing signal, with the output detection reference signal, and to output the comparison signal.

* * * * *